US009938108B2

(12) United States Patent
Noso et al.

(10) Patent No.: US 9,938,108 B2
(45) Date of Patent: Apr. 10, 2018

(54) SHEET PROCESSING APPARATUS AND IMAGE FORMING SYSTEM

(71) Applicant: KYOCERA Document Solutions Inc., Osaka-shi, Osaka (JP)

(72) Inventors: Terumitsu Noso, Osaka (JP); Keisuke Egawa, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 81 days.

(21) Appl. No.: 15/220,264

(22) Filed: Jul. 26, 2016

(65) Prior Publication Data

US 2017/0043972 A1 Feb. 16, 2017

(30) Foreign Application Priority Data

Aug. 10, 2015 (JP) ..... 2015-158010

(51) Int. Cl.

| | |
|---|---|
| ***B65H 35/00*** | (2006.01) |
| ***B26F 1/02*** | (2006.01) |
| ***B65H 29/12*** | (2006.01) |
| ***B65H 31/02*** | (2006.01) |
| ***B65H 31/30*** | (2006.01) |
| ***B65H 31/36*** | (2006.01) |
| ***G03G 15/00*** | (2006.01) |

(Continued)

(52) U.S. Cl.

CPC ..... *B65H 35/0006* (2013.01); *B26F 1/02* (2013.01); *B65H 29/125* (2013.01); *B65H 31/02* (2013.01); *B65H 31/3027* (2013.01); *B65H 31/36* (2013.01); *B65H 37/04* (2013.01); *G03G 15/6582* (2013.01); *B26D 2007/0018* (2013.01); *B65H 2301/4212* (2013.01); *B65H 2301/4213* (2013.01); *B65H 2301/51514* (2013.01); *B65H 2404/1521* (2013.01); *B65H 2801/27* (2013.01); *G03G 2215/00818* (2013.01)

(58) Field of Classification Search

CPC ... B65H 2513/412; B65H 35/006; B26F 1/02; G03G 15/6582

See application file for complete search history.

(56) References Cited

U.S. PATENT DOCUMENTS

| | | | | |
|---|---|---|---|---|
| 2001/0049990 | A1* | 12/2001 | Takaishi | B26D 5/007 83/628 |
| 2013/0228089 | A1* | 9/2013 | Yoshida | B26D 5/00 101/481 |
| 2014/0023417 | A1* | 1/2014 | Miyake | G03G 15/6538 399/407 |

FOREIGN PATENT DOCUMENTS

| | | | |
|---|---|---|---|
| JP | 2002145515 | A | 5/2002 |
| JP | 2005075569 | A | 3/2005 |

(Continued)

*Primary Examiner* — Jennifer Simmons

(74) *Attorney, Agent, or Firm* — Alleman Hall Creasman & Tuttle LLP

(57) ABSTRACT

A first motor causes a first conveying roller pair to rotate, and a second motor causes a second conveying roller pair and an aligning rotational member to rotate. A control portion temporarily stops the first motor each time a sheet member reaches a position at which the sheet member is subjected to punching. Each time the sheet member reaches the position at which the sheet member is subjected to punching, the control portion continuously operates the second motor if the sheet member unreaches a position at which the sheet member is nipped by the second conveying roller pair, and otherwise temporarily stops the second motor.

8 Claims, 15 Drawing Sheets

(51) Int. Cl.
*B65H 37/04* (2006.01)
*B26D 7/00* (2006.01)

(56) References Cited

FOREIGN PATENT DOCUMENTS

| | | | |
|---|---|---|---|
| JP | 2007118121 | A | 5/2007 |
| JP | 2015009955 | A | 1/2015 |

* cited by examiner

SHEET PROCESSING APPARATUS AND IMAGE FORMING SYSTEM

INCORPORATION BY REFERENCE

This application is based upon and claims the benefit of priority from the corresponding Japanese Patent Application No. 2015-158010 filed on Aug. 10, 2015, the entire contents of which are incorporated herein by reference.

BACKGROUND

The present disclosure relates to a sheet processing apparatus and an image forming system including the same.

In general, a sheet processing apparatus connected to an image forming apparatus is known. The sheet processing apparatus is called a post-processing apparatus, for example. The sheet processing apparatus includes, for example, a punching device. The punching device performs a punching process on sheet members that are conveyed from the image forming apparatus.

The sheet processing apparatus may include a stapling device disposed following the punching device. In the stapling device, the sheet members being sequentially conveyed from the punching device are aligned on an inclined tray, and a stapling process is performed on the aligned sheet members.

In the sheet processing apparatus, it is necessary to temporarily stop conveying the sheet member each time the sheet member reaches a position at which it is subjected to punching. To enhance the sheet processing efficiency of the sheet processing apparatus, it is important that the stopping of conveying of the sheet member in the punching device has a minimum influence on a following sheet process.

Furthermore, in the sheet processing apparatus, to increase the compactness of the device and reduce the cost, it is desired that a motor for driving movable portions be shared as much as possible.

For example, when an entrance conveying roller and the following sheet discharge conveying roller in a device provided following the punching device are driven by the same motor, it is known to use an entrance conveying roller including a separation mechanism as the entrance conveying roller. The entrance conveying roller takes over conveying of the sheet member from a punching conveying roller. In this case, when a pair of rollers of the entrance conveying roller are separated from each other, the sheet discharge conveying roller can continue to operate without being affected by stopping of the punching conveying roller.

SUMMARY

A sheet processing apparatus according to one aspect of the present disclosure includes a first conveying roller, a punching device, a second conveying roller, an aligning rotational member, a first conveyance control portion, a position determination portion, and a second conveyance control portion. The first conveying roller is rotationally driven by a first motor. Accordingly, the first conveying roller is a roller configured to convey a sheet member along a conveyance path. The punching device is a device configured to sequentially perform punching on a plurality of locations of the sheet member along a conveying direction. The second conveying roller is rotationally driven by a second motor. Accordingly, the second conveying roller takes over conveying of the sheet member on which the punching has been performed, from the first conveying roller, and feeds out the sheet member from the conveyance path to an inclined tray located therebelow. The aligning rotational member is a rotary member configured to be rotationally driven by the second motor. The aligning rotational member includes an elastic portion that comes into intermittent contact with an upper surface of the sheet member on the inclined tray. The aligning rotational member causes each of the sheet members that are sequentially fed out from the second conveying roller to shift to an alignment position by using a frictional force of the elastic portion. The alignment position is a position at which a lower end of the sheet member is in contact with a stopper located on a lower end side of the inclined tray. The first conveyance control portion temporarily stops the first motor each time the sheet member reaches a position at which the sheet member is subjected to the punching. The position determination portion determines whether or not the sheet member at a position at which the sheet member is subjected to the punching has reached a takeover position at which the sheet member extends over the first conveying roller and the second conveying roller. Each time the sheet member reaches the position at which the sheet member is subjected to the punching, the second conveyance control portion controls whether the second motor is continuously operated or temporarily stopped. At that time, the second conveyance control portion continuously operates the second motor if it is determined that the sheet member unreaches the takeover position, and temporarily stops the second motor if it is determined that the sheet member has reached the takeover position.

An image forming system according to another aspect of the present disclosure includes an image forming apparatus and the above-described sheet processing apparatus. The image forming apparatus forms an image on a sheet member. The sheet processing apparatus is capable of performing the punching on the sheet member that is conveyed from the image forming apparatus.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described with reference to the accompanying drawings. The embodiments described below represent an exemplary implementation of the present disclosure, and are not intended to limit the technical scope of the present disclosure.

First Embodiment

Figure 1:
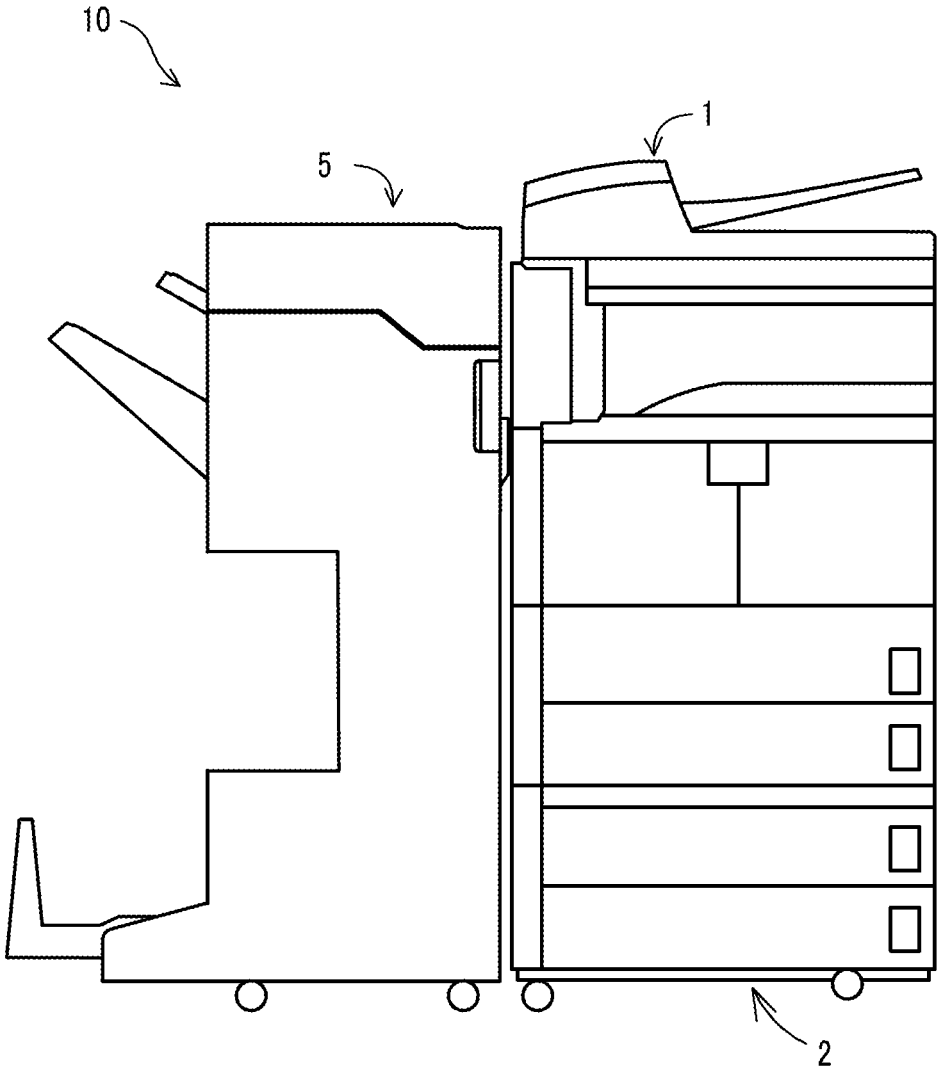
FIG. 1 is a diagram showing a configuration of an image forming system including a sheet processing apparatus according to a first embodiment.

Firstly, a configuration of an image forming system 10 including a sheet processing apparatus 5 according to a first embodiment will be described with reference to FIGS. 1 to 3.

[Image Forming System 10]

The image forming system 10 includes an image reading apparatus 1, an image forming apparatus 2, and a sheet processing apparatus 5. The image forming system 10 shown in FIG. 1 is a multifunction peripheral. The image forming system 10 may be, for example, a printer, a copying machine, or a facsimile apparatus that includes the sheet processing apparatus 5. The multifunction peripheral has the function of the printer, the function of the copying machine, and the like in combination.

[Image Reading Apparatus 1 and Image Forming Apparatus 2]

The image reading apparatus 1 reads an image from a document. In the case where the image forming system 10 executes a copy process, the image forming apparatus 2 forms, on a sheet member 9, an image based on image data of the document outputted from the image reading apparatus 1. Also, the image forming apparatus 2 may form, on the sheet member 9, an image based on a print job received from a terminal, which is not shown.

Figure 2:
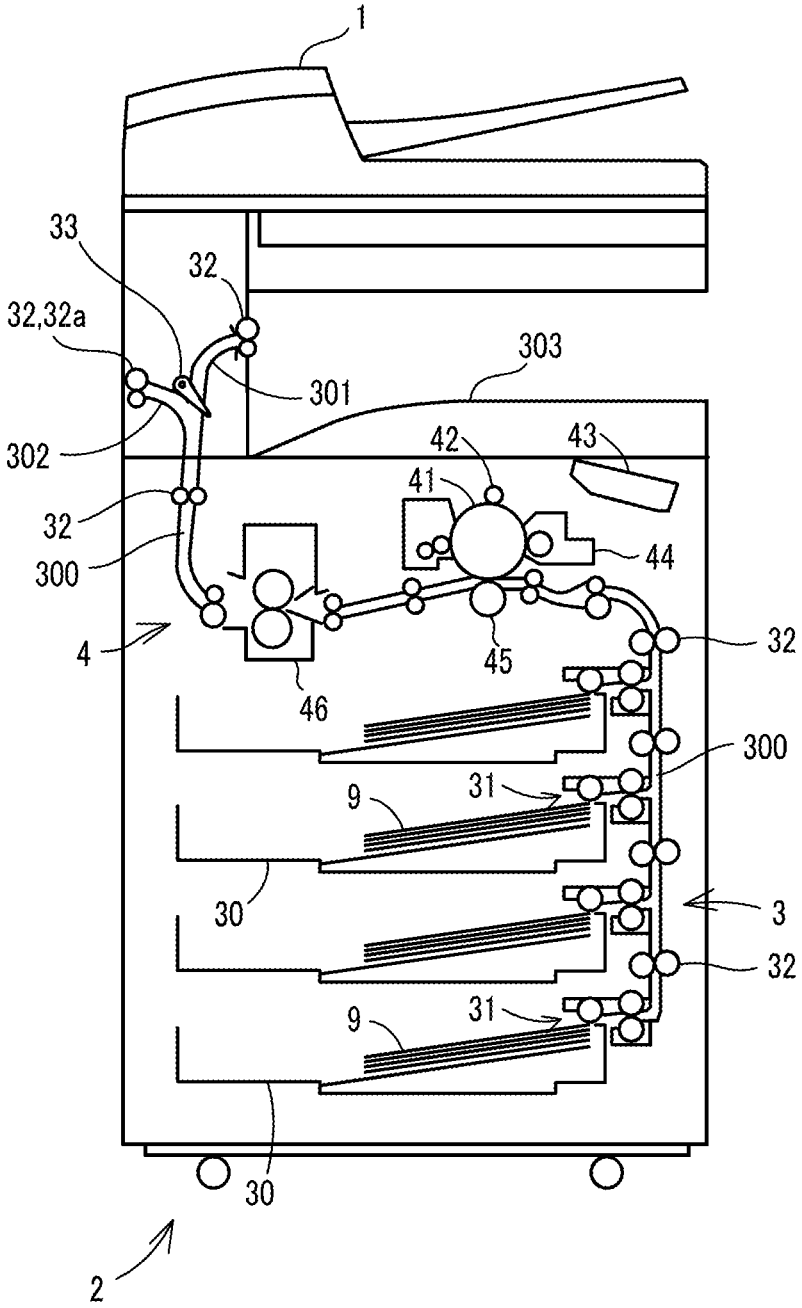
FIG. 2 is a diagram showing configurations of an image reading apparatus and an image forming apparatus.

As shown in FIG. 2, the image forming apparatus 2 includes a sheet conveying portion 3, an image forming portion 4, and the like. The image forming apparatus 2 forms an image by electrophotography. Alternatively, the image forming apparatus 2 may form an image by another method such as an inkjet method.

In the sheet conveying portion 3, a plurality of sheet members 9 are placed so as to be stacked on a sheet receiving portion 30. Each sheet member 9 is a sheet-like image formation medium such as paper, coated paper, a postcard, an envelope, or an OHP sheet. A sheet feeding portion 31 feeds out the sheet members 9 from the sheet receiving portion 30 toward a sheet conveyance path 300.

Conveying rollers 32 of the sheet conveying portion 3 further convey the sheet members 9 toward the image forming portion 4. Thereafter, the conveying rollers 32 convey the sheet members 9 having an image formed thereon, from the sheet conveyance path 300 onto a central discharge tray 303 or into the sheet processing apparatus 5. The conveying rollers 32 each include a pair of rollers that rotate with the sheet member 9 nipped therebetween.

A movable guide 33 of the sheet conveying portion 3 is displaced by a drive source such as a solenoid, which is not shown. Accordingly, the movable guide 33 selectively switches between two conveyance paths for the sheet member 9 having an image formed thereon. The two conveyance paths are a path extending from the sheet conveyance path 300 toward the central discharge tray 303 of the image forming apparatus 2, and a path extending from the sheet conveyance path 300 toward the sheet processing apparatus 5.

The image forming portion 4 forms an image on the surface of the sheet member 9 being moved along the sheet conveyance path 300. In the image forming portion 4, a charging portion 42 uniformly charges the surface of a rotating photosensitive member 41. Furthermore, by a laser scanning portion 43 an electrostatic latent image is written on the surface of the photosensitive member 41 by laser light being applied. A developing portion 44 supplies developer to the photosensitive member 41 so as to develop the electrostatic latent image.

Furthermore, a transfer portion 45 transfers, onto the sheet member 9, the image of the developer formed on the surface of the photosensitive member 41. Thereafter, a fixing portion 46 heats the image of the developer on the sheet member 9 to fix the image onto the sheet member 9.

[Sheet Processing Apparatus 5]

The sheet processing apparatus 5 is an apparatus capable of performing a sheet process on the sheet members 9 that are conveyed from the image forming apparatus 2. The sheet process includes punching and a sheet alignment process on the sheet members 9. A punching device 6 performs the punching on the sheet member 9, and a sheet aligning device 7 performs a sheet alignment process on the sheet members 9.

Figure 3:
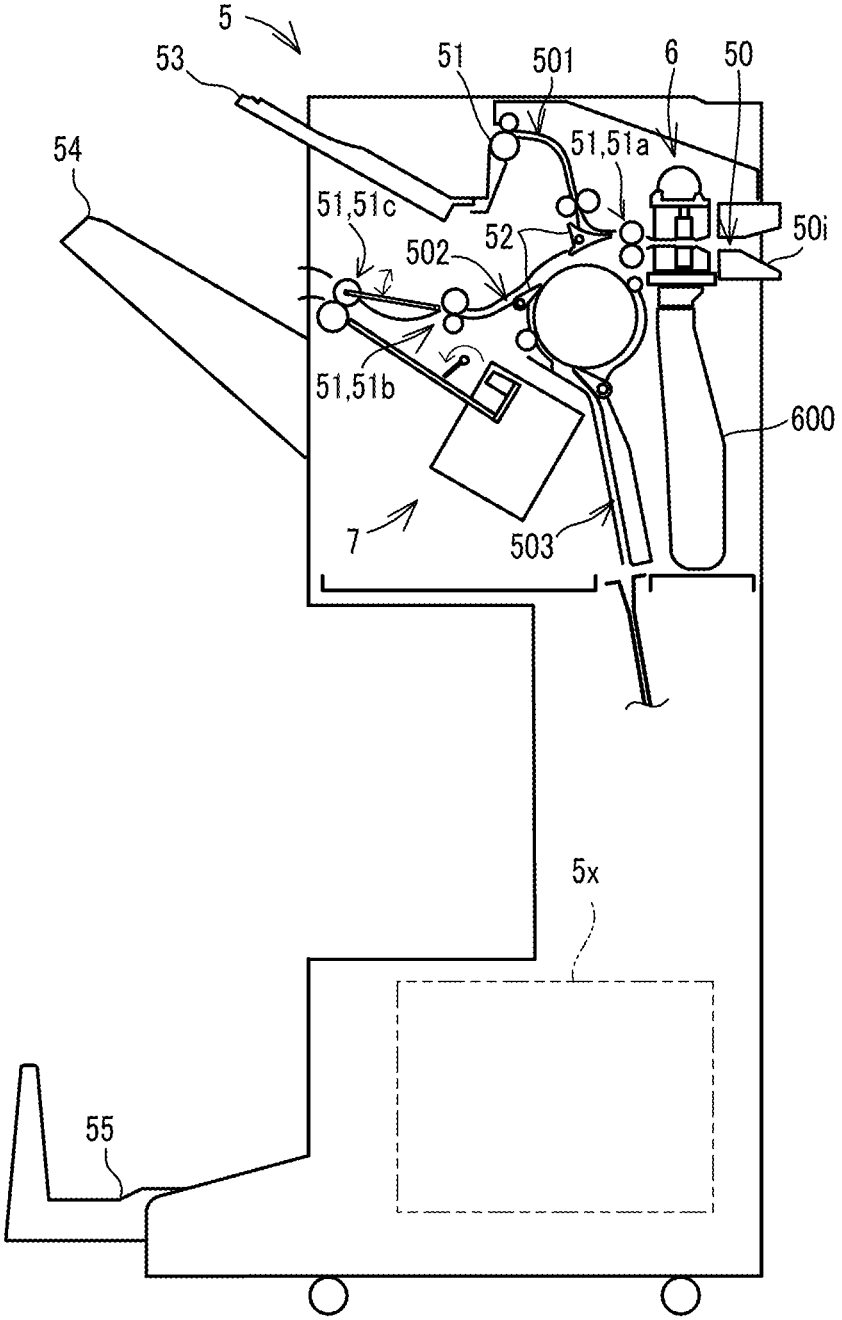
FIG. 3 is a diagram showing a configuration of the sheet processing apparatus according to the first embodiment.

In the example shown in FIG. 3, the sheet processing apparatus 5 also includes a sheet folding device 5*x* or the like, in addition to the punching device 6 and the sheet aligning device 7. In FIG. 3, illustration of the configuration of the sheet folding device 5*x* is omitted.

The sheet processing apparatus 5 may include a mechanism for conveying the sheet members 9 set on a tray (not shown) to a position at which the sheet process is performed. In this case, the sheet processing apparatus 5 is capable of performing, also when the image forming apparatus 2 is not provided, the sheet process independently thereof.

The sheet processing apparatus 5 includes, for example, conveying rollers 51, movable guides 52, the punching device 6, the sheet aligning device 7, the sheet folding device 5*x*, a first discharge tray 53, a second discharge tray 54, and a third discharge tray 55. Each conveying roller 51 includes a pair of rollers that rotate with the sheet member 9 nipped therebetween.

For example, an introduction conveyance path 50, a first conveyance path 501, a second conveyance path 502, and a third conveyance path 503, each of which serves as a conveyance path for the sheet member 9, are formed inside the sheet processing apparatus 5.

The conveying rollers 51 convey the sheet member 9 along each of the introduction conveyance path 50, the first conveyance path 501, the second conveyance path 502, and the third conveyance path 503. The sheet member 9 that is conveyed from the image forming apparatus 2 enters the introduction conveyance path 50 from a sheet inlet 50*i* of the sheet processing apparatus 5. The sheet inlet 50*i* is in communication with the exit of the sheet conveyance path 300 of the image forming apparatus 2.

The movable guides 52 are displaced by a drive source such as a solenoid, which is not shown. Accordingly, the movable guides 52 selectively switch between the following conveyance paths for the sheet member 9 that is conveyed along the introduction conveyance path 50. The following conveyance paths are the first conveyance path 501, the second conveyance path 502, and the third conveyance path 503.

The punching device 6 performs punching on the sheet member 9 that is conveyed from the image forming apparatus 2 along the introduction conveyance path 50. The punching device 6 includes a collection container 600 therebelow. Sheet pieces are cut out from the sheet member 9 as a result of the punching.

The sheet pieces resulting from the punching fall from the introduction conveyance path 50, and are collected in the collection container 600. The collection container 600 is detachably mounted to the sheet processing apparatus 5.

In the following description, conveying rollers disposed immediately preceding and immediately following the punching device 6 are referred to as a "preceding conveying roller 32*a*" and a "following conveying roller 51*a*". The preceding conveying roller 32*a* and the following conveying roller 51*a* convey the sheet member 9 along the introduction conveyance path 50.

The sheet member 9 that has been conveyed from the introduction conveyance path 50 to the first conveyance path 501 is discharged directly to the first discharge tray 53 by the conveying roller 51.

The sheet aligning device 7 aligns and holds a plurality of the sheet members 9 that are sequentially conveyed to the second conveyance path 502, and performs a stapling process on the sheet members 9. A bundle of the sheet members 9 on which the stapling process has been performed is discharged to the second discharge tray 54 by the conveying roller 51.

The sheet folding device 5*x* performs a sheet folding process for folding, in two or three, each of the sheet members 9 that have been conveyed to the third conveyance path 503. The sheet members 9 on which the sheet folding process has been performed are discharged to the third discharge tray 55 by a conveying roller 51.

[Punching Device 6]

Next, a configuration of the punching device 6 will be described with reference to FIGS. 3 and 4.

In the following description, a conveying direction in which the sheet members 9 are conveyed along the introduction conveyance path 50 and the following second conveyance path 502 is referred to as a "first direction R1". The direction orthogonal to the first direction R1 is referred to as a "second direction R2". The second direction R2 is a width direction of the sheet members 9 being moved along the introduction conveyance path 50 and the second conveyance path 502.

A first side end and a second side end of the introduction conveyance path 50 in the second direction R2 are referred to as a "first path side end 50*a*" and a "second path side end 50*b*", respectively. The distance between the first path side end 50*a* and the second path side end 50*b* corresponds to about a distance obtained by adding a slight margin to the width of the sheet member 9, having the maximum size, which can pass through the introduction conveyance path 50.

Figure 4:
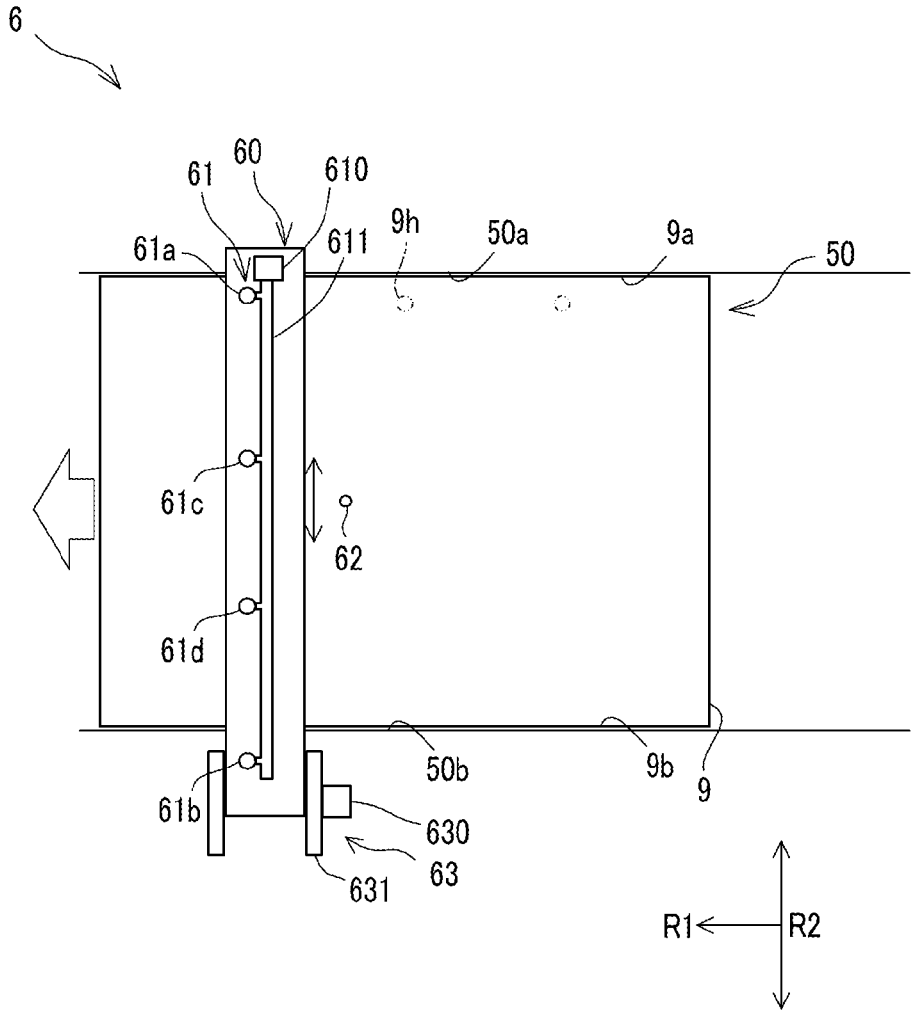
FIG. 4 is a partial schematic plan view of a punching device included in the sheet processing apparatus according to the first embodiment.

In FIG. 4, the right end of the introduction conveyance path 50 as viewed in the first direction R1 is represented as an example of the first path side end 50*a*. The left end of the introduction conveyance path 50 as viewed in the first direction R1 is represented as an example of the second path side end 50*b*.

As shown in FIGS. 3 and 4, the punching device 6 includes a punching unit 60, a sheet sensor 62, a displacement mechanism 63, and the like. The punching unit 60 includes punching portions 61, a punching motor 610, a link mechanism 611, and the like.

The displacement mechanism 63 is a drive mechanism for reciprocating and displacing the punching unit 60 along the second direction R2. The displacement mechanism 63 can reciprocate and displace the punching unit 60 along the second direction R2 and stop the punching unit 60 at a targeted position.

The displacement mechanism 63 includes a displacement motor 630 serving as a drive source, and a link mechanism 631 for transmitting the power of the displacement motor 630 to the punching portions 61. The displacement motor 630 is, for example, a stepping motor or a servomotor.

Each punching portion 61 performs the punching on the sheet member 9 that is conveyed along the introduction conveyance path 50. In the present embodiment, the punching device 6 includes a plurality of punching portions 61*a*, 61*b*, 61*c*, and 61*d*.

The first punching portion 61*a* is provided at a position, in the punching unit 60, on the first path side end 50*a* side. The second punching portion 61*b* is provided at a position, in the punching unit 60, on the second path side end 50*b* side.

The third punching portion 61*c* and the fourth punching portion 61*d* are provided between the first punching portion 61*a* and the second punching portion 61*b* of the punching unit 60. One punching portion or three or more punching portions may be provided between the first punching portion 61*a* and the second punching portion 61*b* of the punching unit 60.

Each of the punching portions 61 is supported such that the punching portion 61 can be reciprocated and displaced between a retraction position and an operation position. At the retraction position, the punching portion 61 is separated from the sheet member 9 located in the introduction conveyance path 50. At the operation position, the punching portion 61 penetrates through the sheet member 9 located in the introduction conveyance path 50. For example, each of the punching portions 61 may be a punching blade supported by a spring. In this case, elastic force by which the punching blade is restored from the operation position to the retraction position acts on the punching blade from the spring.

The punching motor 610 is a drive source for the punching portions 61. The punching motor 610 causes each of the punching portions 61 to be reciprocated and displaced between the retraction position and the operation position via the link mechanism 611. The punching motor 610 is, for example, a servomotor.

In the present embodiment, the first punching portion 61*a* and the second punching portion 61*b* simultaneously operate in accordance with a first operation of the punching motor 610. The third punching portion 61*c* and the fourth punching portion 61*d* simultaneously operate in accordance with a second operation of the punching motor 610.

That is, the first punching portion 61*a* and the second punching portion 61*b* operate in conjunction with each other in accordance with the first operation of the punching motor 610. The third punching portion 61*c* and the fourth punching portion 61*d* operate in conjunction with each other in accordance with the second operation of the punching motor 610. The first punching portion 61*a* and the second punching portion 61*b* operate independently of the third punching portion 61*c* and the fourth punching portion 61*d*.

In a state in which the sheet member 9 has reached a position along the punching unit 60, the punching portions 61 are displaced from the retraction position to the operation position. Thus, punch holes 9*h* are formed in the sheet member 9. In FIG. 4 and the like, the punch holes 9*h* indicated by the dashed double-dotted line are holes that are to be formed in the sheet member 9.

The punching device 6 has various functions for performing a width direction punching process and a conveying direction punching process. The width direction punching process is a process for simultaneously performing the punching on a plurality of locations of the sheet member 9 along the second direction R2.

In the punching device 6, the third punching portion 61*c* and the fourth punching portion 61*d* are used for the punching in the width direction punching process.

The conveying direction punching process is a process for sequentially performing the punching on a plurality of locations of the sheet member 9 along the first direction R1. In the conveying direction punching process, the punching device 6 can form the punch hole 9*h* in a portion, of the sheet member 9, which is located on a first edge 9*a* side or a second edge 9*b* side. The first edge 9*a* is an edge of the sheet member 9 that is located on the first path side end 50*a* side. The second edge 9*b* is an edge of the sheet member 9 that is located on the second path side end 50*b* side.

In the punching device 6, the first punching portion 61*a* and the second punching portion 61*b* are used for the punching in the conveying direction punching process. The first punching portion 61*a* is used for the punching on a portion, of the sheet member 9, which is located on the first edge 9*a* side. The second punching portion 61*b* is used for the punching on a portion, of the sheet member 9, which is located on the second edge 9*b* side.

When the punch hole 9*h* is formed in a portion, of the sheet member 9, which is located on the first edge 9*a* side, the displacement mechanism 63 positions the punching unit 60 such that the first punching portion 61*a* opposes the location of the sheet member 9 in which the punch hole 9*h* is to be formed.

When the punch hole 9*h* is formed in a portion, of the sheet member 9, which is located on the second edge 9*b* side, the displacement mechanism 63 positions the punching unit 60 such that the second punching portion 61*b* opposes the location of the sheet member 9 in which the punch hole 9*h* is to be formed.

The sheet sensor 62 is a sensor for detecting a leading end of the sheet member 9 that is conveyed along the introduction conveyance path 50. For example, the sheet sensor 62 may be, for example, a reflective photosensor or a transmissive photosensor.

The sheet sensor 62 is fixed to a supporting portion (not shown) at a position upstream of the position of the punching portion 61 in the first direction R1. Further, the sheet sensor 62 is fixed at a position between the first path side end 50*a* and the second path side end 50*b* in the second direction R2. The position of the punching portions 61 is a position at which the punching device 6 performs processing in the introduction conveyance path 50.

A detection result from the sheet sensor 62 is used as a reference for the positioning of the sheet member 9 in the first direction R1 when a punch hole 9*h* is formed in the sheet member 9. In the present embodiment, the preceding conveying roller 32*a* and the following conveying roller 51*a* stop the sheet member 9 at a targeted position in the first direction R1.

[Sheet Aligning Device 7]

Next, a configuration of the sheet aligning device 7 will be described with reference to FIGS. 3 and 5.

The sheet aligning device 7 includes an inclined tray 71, a stopper 72, an aligning rotational member 73, a stapling device 74, and the like. The inclined tray 71 is disposed below the exit of the second conveyance path 502.

The sheet member 9 on which the punching has been performed is fed out from the second conveyance path 502 to the inclined tray 71 located therebelow by the conveying roller 51 located at the exit of the second conveyance path 502. In the following description, the conveying roller 51 provided at the exit of the second conveyance path 502 is referred to as an "intermediate conveying roller 51*b*".

The aligning rotational member 73 includes a shaft portion 730 and an elastic portion 731. The aligning rotational member 73 rotates about the shaft portion 730. Accordingly, the elastic portion 731 pivots. As will be described below, the aligning rotational member 73 is driven by the same motor as that for the intermediate conveying roller 51*b*.

The elastic portion 731 is, for example, an elastically deformable member such as a plate-like rubber member. Further, the elastic portion 731 is a member having a relatively high frictional resistance to the sheet member 9. Rotation of the aligning rotational member 73 causes the elastic portion 731 to come into intermittent contact with the upper surface of the sheet member 9 on the inclined tray 71.

By means of the elastic portion 731 that pivots in contact with the sheet member 9, the aligning rotational member 73 causes the sheet members 9 that are sequentially fed out from the intermediate conveying roller 51*b* to move to an alignment position at which the trailing end of the sheet members 9 is in contact with the stopper 72 located on the lower end side of the inclined tray 71. The trailing end of the sheet members 9 is an upstream end of the sheet members 9 in the feeding direction in which the intermediate conveying roller 51*b* feeds the sheet members 9. Accordingly, a preset number of sheet members 9 are aligned in the alignment position on the inclined tray 71.

The stapling device 74 performs a stapling process on the sheet members 9 aligned in the alignment position on the inclined tray 71.

Furthermore, the conveying roller 51 provided on the upper end side of the inclined tray 71 discharges, to the second discharge tray 54, a bundle of the sheet members 9 on which the stapling process has been performed in the alignment position.

In the following description, the conveying roller 51 provided on the upper end side of the inclined tray 71 is referred to as a "discharge roller 51*c*". The discharge roller 51*c* includes a pair of rollers supported so as to be separable from each other.

That is, one of the paired rollers included in the discharge roller 51*c* is supported so as to be displaced between a position in proximity to and a position distant from the other of the paired rollers. In the following description, a state in which the paired rollers of the discharge roller 51*c* are in proximity to each other and a state in which they are distant from each other are referred to as "closed state" and "open state", respectively.

The discharge roller 51*c* nips and conveys the sheet member 9 in the closed state, and forms a passage through which the sheet member 9 can freely pass in the open state. The discharge roller 51*c* conveys the sheet member 9 toward the second discharge tray 54 by rotating in the forward direction. The discharge roller 51*c* can also rotate in the backward direction under control of a control portion 8, which will be described later.

[Basic Procedure of Conveying of Sheet Member 9 from Introduction Conveyance Path 50 to Second Discharge Tray 54]

Next, a basic procedure of conveying of the sheet member 9 from the introduction conveyance path 50 to the second discharge tray 54 will be described with reference to FIGS. 5 to 10.

In the following description, a conveyance path extending from the introduction conveyance path 50 to the second conveyance path 502 is referred to as a "main conveyance path 500".

Figure 5:
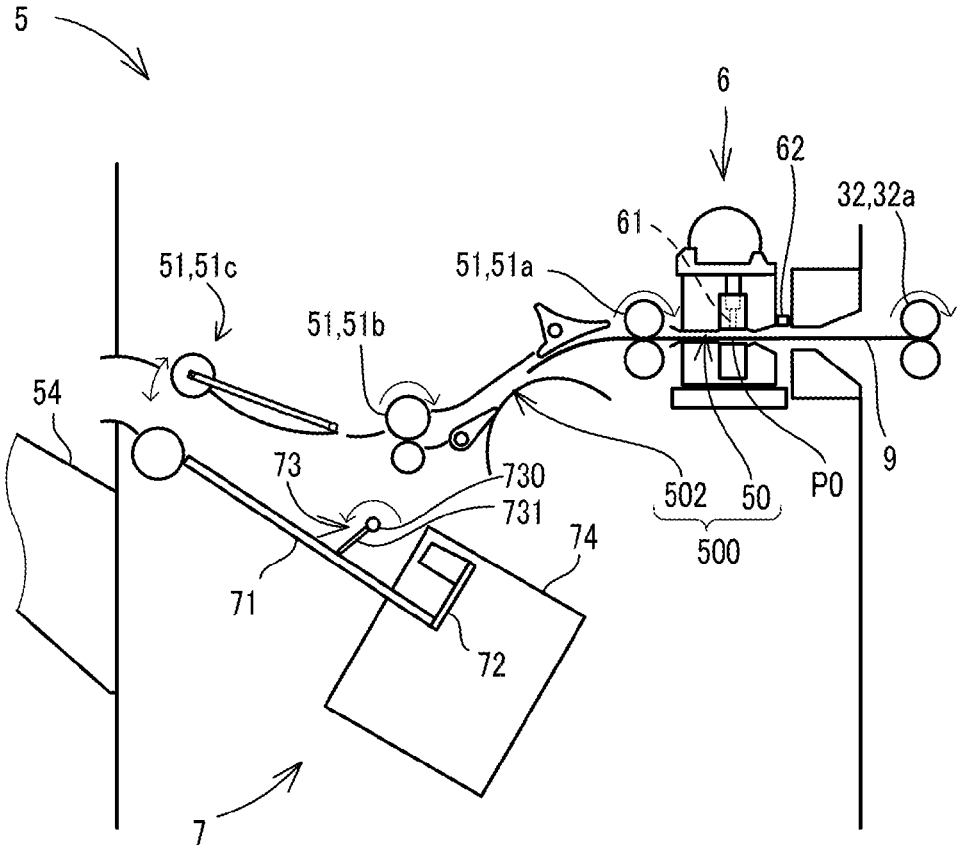
FIG. 5 is a diagram showing a configuration of a portion including the punching device and a sheet aligning device in the sheet processing apparatus according to the first embodiment.

As shown in FIG. 5, the preceding conveying roller 32*a* and the following conveying roller 51*a* convey the sheet member 9 along the main conveyance path 500. At this time, the preceding conveying roller 32*a* and the following conveying roller 51*a* are temporarily stopped each time the location of the sheet member 9 on which the punching is to be performed reaches the position of the punching portion 61.

Then, when the conveying of the sheet member 9 has been temporarily stopped, the punching device 6 performs the punching on the sheet member 9. In the case where the conveying direction punching process is performed, the temporary stopping of the conveying of the sheet member 9 and the punching are repeated for a plurality of times. The following conveying roller 51*a* is an example of a first conveying roller that is rotationally driven by a first conveying motor 34, which will be described later.

When the punching is performed at least on the first location, of the sheet member 9, from the leading end side in the conveying direction punching process, the leading end of the sheet member 9 has not reached the intermediate conveying roller 51*b* (see FIG. 5).

Figure 6:
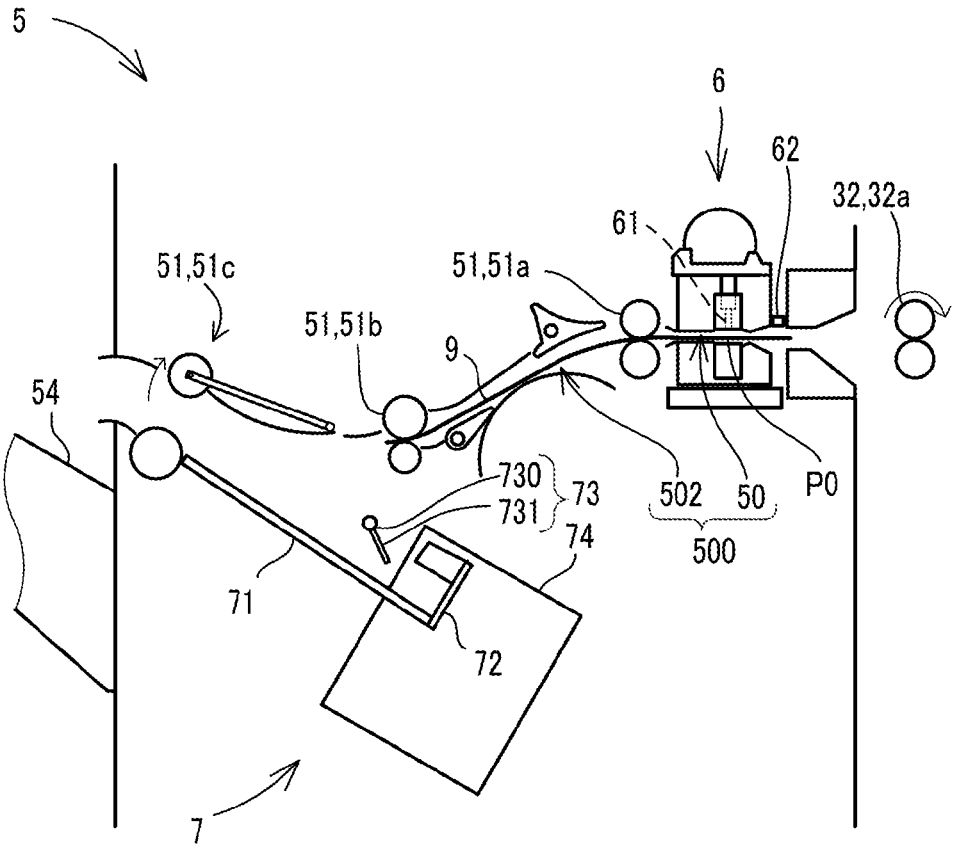
FIG. 6 is a diagram showing a part of the sheet processing apparatus in the case of a sheet member having reached a takeover position.

On the other hand, when the punching is performed on a location, of the sheet member 9, on the trailing end side thereof, the sheet member 9 extends over the following conveying roller 51*a* and the intermediate conveying roller 51*b* (see FIG. 6). That is, by rotation, the intermediate conveying roller 51*b* takes over, from the following conveying roller 51*a*, the conveying of the sheet member 9 on which the punching has been performed.

Figure 9:
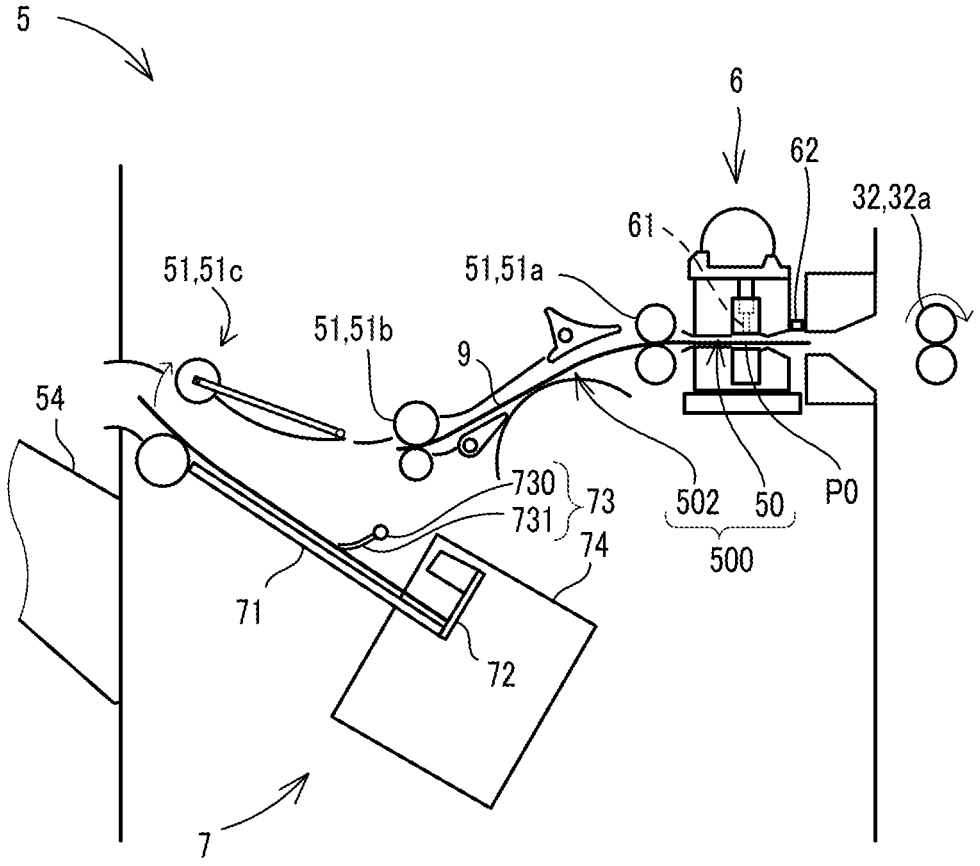
FIG. 9 is a diagram showing a part of the sheet processing apparatus in the case of the second sheet member having reached the takeover position.

In the following description, the position of the sheet member 9 in a state where the sheet member 9 extends over the following conveying roller 51*a* and the intermediate conveying roller 51*b* is referred to as a "takeover position". The takeover position is a position at which the sheet member 9 that is subjected to the punching is nipped by the intermediate conveying roller 51*b* (roller pair). FIG. 9 shows a situation where the second sheet member 9 has reached the takeover position.

The intermediate conveying roller 51*b* takes over conveying of the sheet member 9 from the following conveying roller 51*a* and feeds out the sheet member 9 from the main conveyance path 500 to the inclined tray 71 located therebelow. Consequently, the sheet members 9 are sequentially fed out from the intermediate conveying roller 51*b* onto the inclined tray 71 in a state in which the trailing end of the sheet members 9 faces the lower end side of the inclined tray 71. The intermediate conveying roller 51*b* is an example of a second conveying roller pair that is rotationally driven by a second conveying motor 56, which will be described later.

Figure 7:
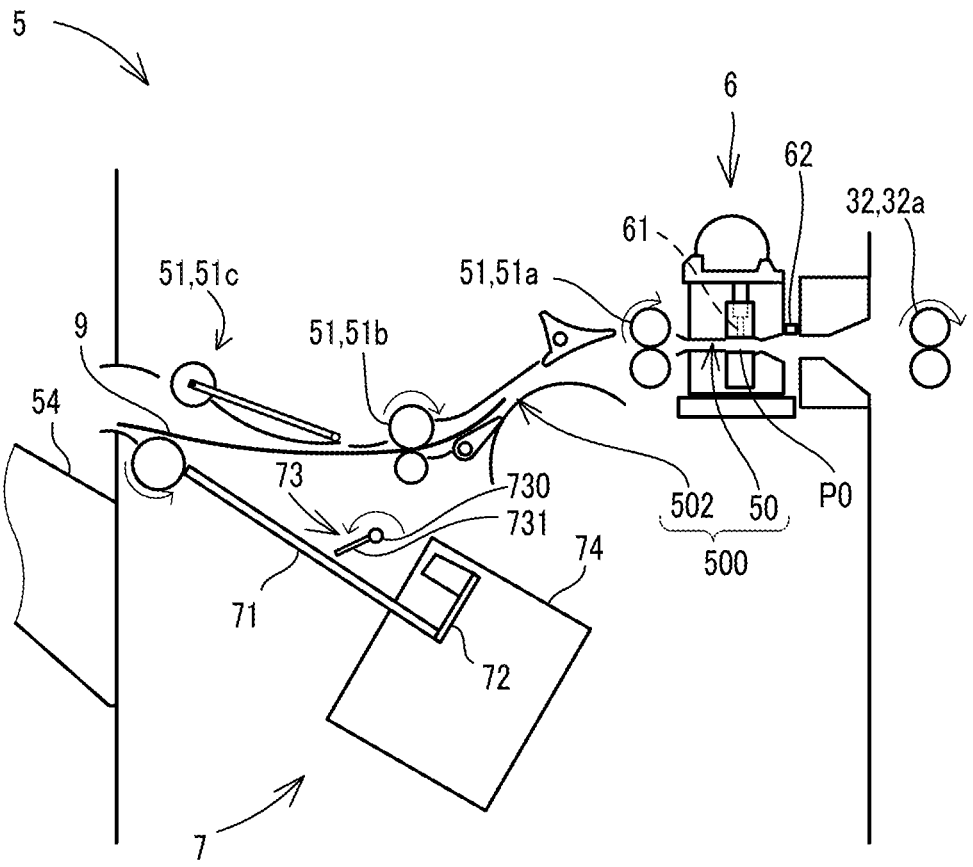
FIG. 7 is a diagram showing a part of the sheet processing apparatus in a state before a sheet member is received by the sheet aligning device.

As shown in FIG. 7, when the sheet member 9 is fed out from the main conveyance path 500, the discharge roller 51*c* is maintained in the open state. Accordingly, the leading end of the sheet member 9 that has been fed out from the main conveyance path 500 enters between the pair of rollers of the discharge roller 51*c*. At this time, the discharge roller 51*c* is rotating in the forward direction.

Next, by the discharge roller 51*c* being switched to the closed state, the discharge roller 51*c* takes over the conveying of the sheet member 9, from the intermediate conveying roller 51*b*. Thereafter, the discharge roller 51*c* rotates in the backward direction. Accordingly, the sheet member 9 that has been fed out onto the inclined tray 71 is conveyed obliquely downward from its lower end side along the inclined tray 71 (see FIG. 8).

Next, the discharge roller 51*c* rotating in the backward direction shifts to the open state. Consequently, the aligning rotational member 73 takes over the obliquely downward conveying of the sheet member 9, from the discharge roller 51*c*. Then, the aligning rotational member 73 that is rotating aligns the sheet members 9 on the inclined tray 71 in the alignment position.

Figure 10:
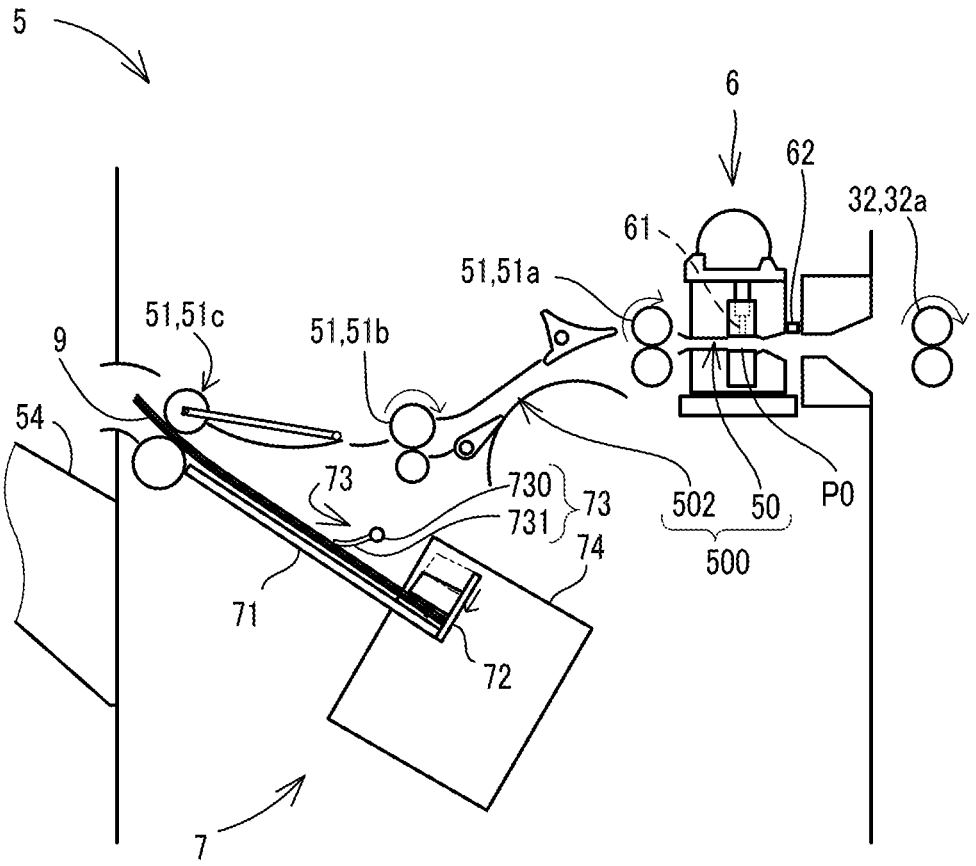
FIG. 10 is a diagram showing a part of the sheet processing apparatus in the case of a stapling process being performed.

When a preset number of the sheet members 9 have been fed out onto the inclined tray 71 and further aligned in the alignment position, the stapling device 74 performs the stapling process on the sheet members 9 in the alignment position (see FIG. 10).

For example, the stapling device 74 performs the stapling process on a position selected in advance from a plurality of candidate locations of the sheet members 9, such as a corner portion or two locations, near the center portion, on one of sides.

Figure 11:
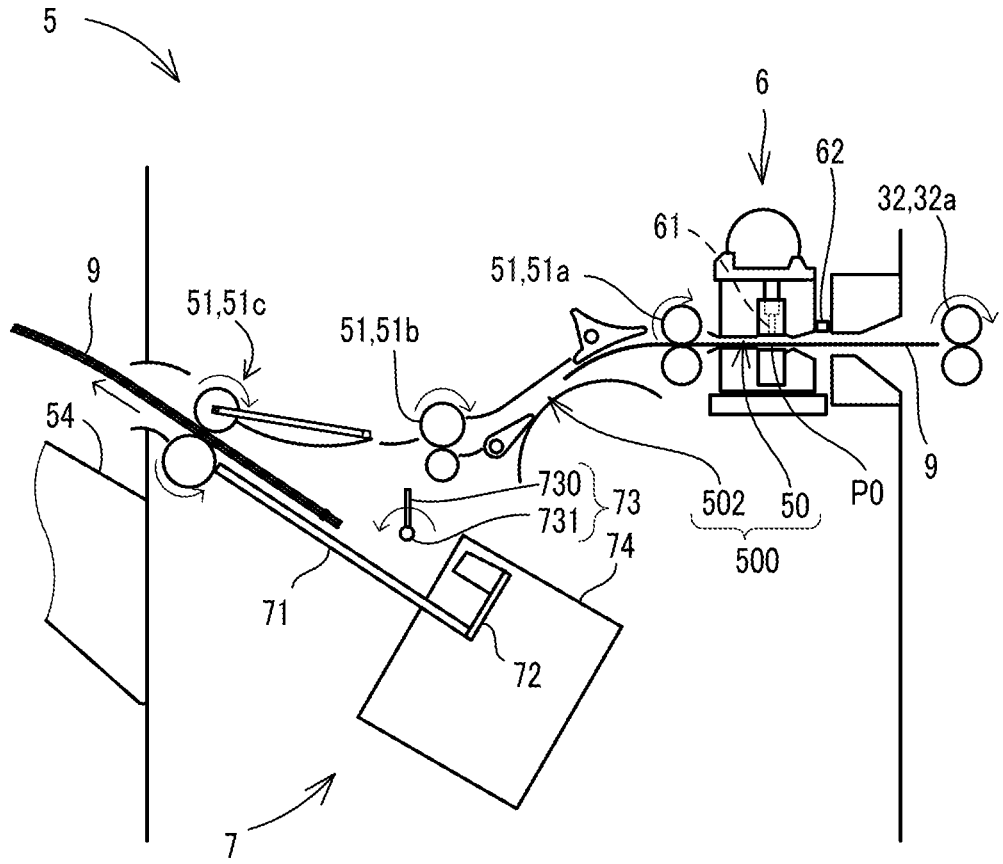
FIG. 11 is a diagram showing a part of the sheet processing apparatus in the case of a sheet member being discharged from the sheet aligning device.

Thereafter, the discharge roller 51*c* shifts to the closed state and rotates in the forward direction (see FIG. 11). Accordingly, the discharge roller 51*c* discharges a bundle of the sheet members 9 in the alignment position to the second discharge tray 54.

[Configuration of Control-Related Devices]

Figure 12:
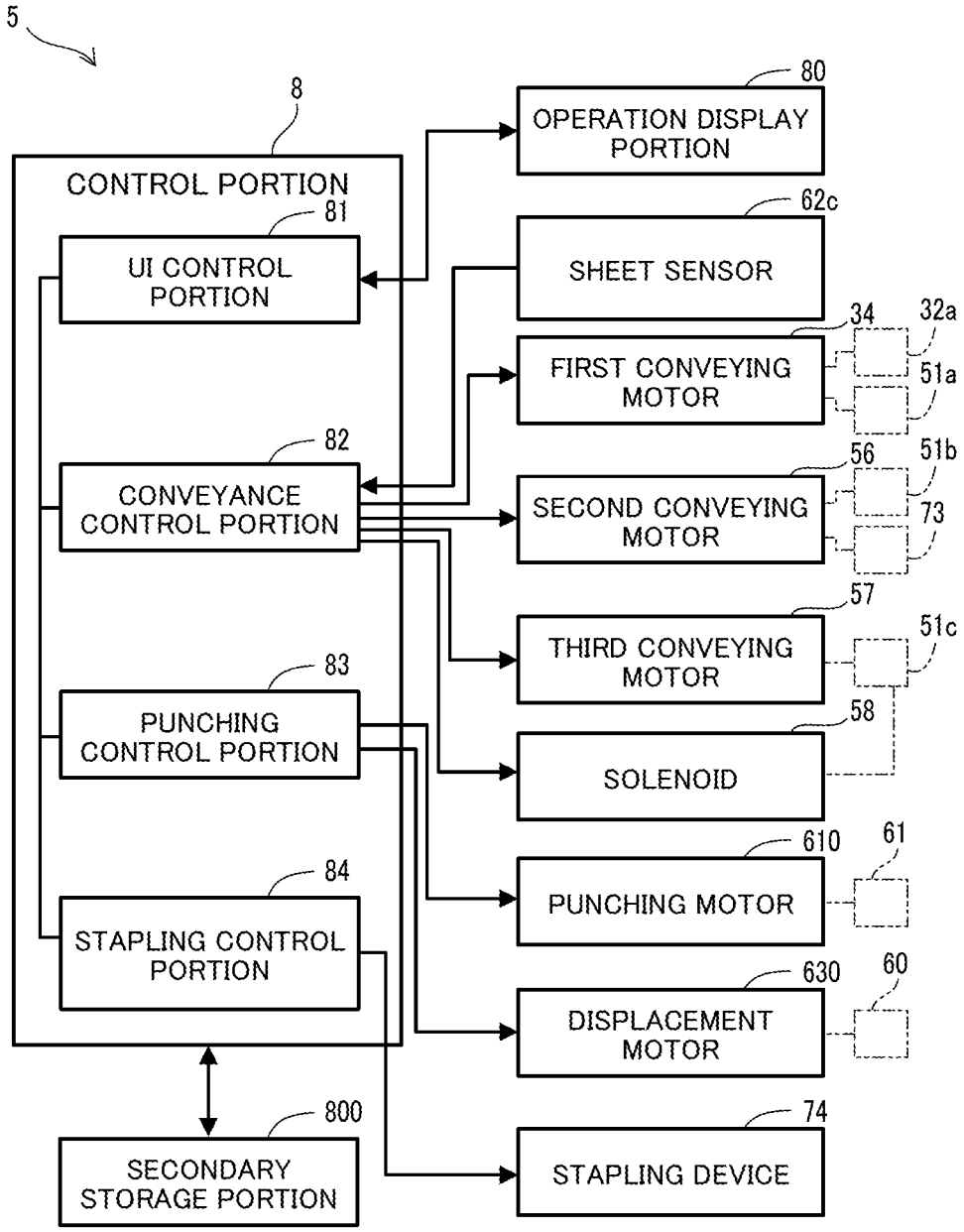
FIG. 12 is a block diagram of control-related devices in the sheet processing apparatus according to the first embodiment.

Next, a configuration of control-related devices of the sheet processing apparatus 5 will be described with reference to FIG. 12. The sheet processing apparatus 5 also includes a control portion 8, a secondary storage portion 800, an operation display portion 80, and the like. The control portion 8 also serves as an overall control portion of the image forming system 10.

The operation display portion 80 is a user interface (UI) device. The operation display portion 80 includes an information input operation portion including, for example, a touch panel and operation buttons, and a panel-shaped display portion such as a liquid crystal display panel.

The control portion 8 controls various electric devices included in the sheet processing apparatus 5. The control portion 8 includes a UI control portion 81, a conveyance control portion 82, a punching control portion 83, a stapling control portion 84, and the like. The UI control portion 81, the conveyance control portion 82, the punching control portion 83, and the stapling control portion 84 are capable of exchanging information with each other via a bus, a shared memory, or the like.

The UI control portion 81 controls the operation display portion 80. For example, the UI control portion 81 causes the operation display portion 80 to display an operation menu or the like. Furthermore, the UI control portion 81 transfers, to another control portion, input information that is inputted through the operation of the operation display portion 80.

The conveyance control portion 82 controls a first conveying motor 34, a second conveying motor 56, a third conveying motor 57, and a solenoid 58.

The first conveying motor 34 is a motor that rotationally drives the preceding conveying roller 32*a* and the following conveying roller 51*a*. The second conveying motor 56 is a motor that rotationally drives the intermediate conveying roller 51*b* and the aligning rotational member 73. The first conveying motor 34 and the second conveying motor 56 are examples of the first motor and the second motor, respectively.

That is, the first conveying motor 34 is a motor shared by the preceding conveying roller 32*a* and the following conveying roller 51*a*. The second conveying motor 56 is a motor shared by the intermediate conveying roller 51*b* and the aligning rotational member 73.

The third conveying motor 57 is a motor that rotationally drives the discharge roller 51*c*. The solenoid 58 is a drive source that switches the discharge roller 51*c* to each of the closed state and the open state. For example, the first conveying motor 34 and the third conveying motor 57 may be servomotors or stepping motors.

For example, the conveyance control portion 82 controls the first conveying motor 34 in accordance with a detection result from the sheet sensor 62. Accordingly, the conveyance control portion 82 stops the sheet member 9 at the targeted position on the main conveyance path 500.

The punching control portion 83 controls the punching motor 610 so as to cause the punching portion 61 to perform the punching. Furthermore, the punching control portion 83 controls the displacement motor 630 so as to displace the punching unit 60, in the second direction R2, to the targeted position.

The stapling control portion 84 controls the stapling device 74 so as to cause the stapling device 74 to perform the stapling process.

For example, the control portion 8 may include, for example, an MPU (Micro Processor Unit) that executes a program stored in advance in the secondary storage portion 800, and a RAM (Random Access Memory). The RAM is a volatile main storage portion that temporarily stores a program to be executed by the MPU.

Then, the MPU that executes a control program for the operation display portion 80 may function as the UI control portion 81. Likewise, the MPU that executes a punching control program may function as the conveyance control portion 82.

Likewise, the MPU that executes the punching control program may function as the punching control portion 83. Likewise, the MPU that executes a stapling control program may function as the stapling control portion 84.

Alternatively, the UI control portion 81, the conveyance control portion 82, the punching control portion 83, and the stapling control portion 84 may be each configured by, for example, a DSP (Digital Signal Processor) or an ASIC (Application Specific Integrated Circuit).

The secondary storage portion 800 is a non-volatile storage portion that stores various types of information to which the control portion 8 refers. The secondary storage portion 800 is also a storage portion from which and into which various types of information can be read and written by the control portion 8.

In the present embodiment, the control portion 8 also serves as the control portion of the image reading apparatus 1 and the image forming apparatus 2. Therefore, the control portion 8 also includes other components (not shown) related to the control of the image reading apparatus 1 and the image forming apparatus 2.

In the sheet processing apparatus 5, in order to achieve enhanced compactness of the apparatus and reduction in cost and noise for the apparatus, there is a need to share the motor for driving the movable portions as much as possible, without adding a new drive mechanism such as the separation mechanism for the conveying roller.

In the case where the second conveying motor 56 is shared as the drive source of the intermediate conveying roller 51*b* and the aligning rotational member 73, the following problem may arise.

Figure 8:
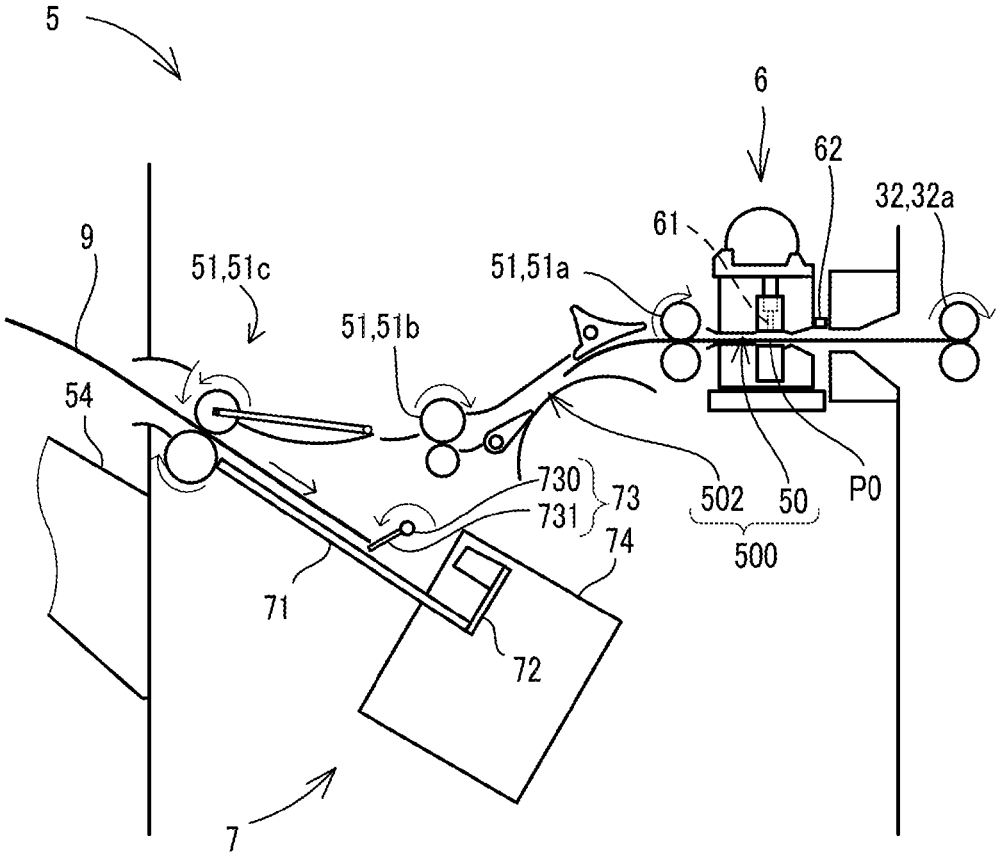
FIG. 8 is a diagram showing a part of the sheet processing apparatus in the case of a sheet member being received by the sheet aligning device.

FIG. 8 shows a situation where, when the sheet member 9 is received by the inclined tray 71 of the sheet aligning device 7, the subsequent sheet member 9 is subjected to the punching. In this case, if the intermediate conveying roller 51*b* is stopped in synchronization with the stopping of the following conveying roller 51*a* when the punching is performed, the aligning rotational member 73 is also stopped.

At the time when the punching is performed on a location relatively close to the leading end side of the sheet member 9 in the conveying direction punching process, the preceding sheet member 9 may not have reached the position of the aligning rotational member 73 on the inclined tray 71 (see FIG. 8). In this case, if the aligning rotational member 73 is stopped, the aligning rotational member 73 may flip obliquely upward or block the sheet member 9. Then, when the aligning rotational member 73 rotates next time, misalignment of the sheet members 9 may occur.

In the case where the second conveying motor 56 is shared as the drive source of the intermediate conveying roller 51*b* and the aligning rotational member 73, it is necessary to solve the above-described problem.

At the time when the punching is performed on a location relatively close to the trailing end side of the sheet member 9, the preceding sheet member 9 has already reached the position of the aligning rotational member 73 on the inclined tray 71 (see FIG. 9). Even if the aligning rotational member 73 is stopped at this time, the problem of misalignment will not occur.

Adopting the sheet processing apparatus 5 makes it possible to share the motor for driving the movable portions located following the punching device 6, without adding a drive mechanism, and it is thus possible to achieve the compactness and reduction in cost and noise for the apparatus. In the following, this will be described in detail.

[Image-Forming-Punching-Stapling-Process]

Next, an exemplary procedure of the image-forming-punching-stapling-process performed by the image forming apparatus 2 and the sheet processing apparatus 5 will be described with reference to the flowchart shown in FIG. 13.

The image-forming-punching-stapling-process is a process for forming an image on the sheet member 9, and performing the punching and the stapling process on the sheet member 9 having the image formed thereon.

In the following description, S101, S102, . . . denote identification characters of steps executed by the control portion 8. The image-forming-punching-stapling-process starts when a predetermined starting operation is performed on the operation display portion 80.

<Step S101>

Firstly, the UI control portion 81 executes an operation condition setting process. The operation condition setting process is a process for setting an operation condition and the like for the image forming process, the punching, and the stapling process, in accordance with an operation performed on the operation display portion 80.

For example, the UI control portion 81 causes the display portion of the operation display portion 80 to display a predetermined selection menu screen. Furthermore, the UI control portion 81 sets an operation condition for each of the processes among predetermined selection candidates, in accordance with an operation performed on the operation portion of the operation display portion 80.

A case where an operation mode in which the conveying direction punching process is executed is set as the operation condition for the punching will be described below.

When a predetermined confirmation operation is performed on the operation display portion 80, the UI control portion 81 advances the process to the subsequent step S102.

<Step S102>

Next, a print control portion (not shown) of the control portion 8 causes the image forming portion 4 to perform an image forming process. Consequently, an image is formed on the sheet member 9, and the sheet member 9 having the image formed thereon is conveyed from the image forming apparatus 2 to the introduction conveyance path 50.

<Step S103>

Next, when an operation mode of the conveying direction punching process is set at step S101, the conveyance control portion 82 and the punching control portion 83 of the control portion 8 perform the conveying direction punching process. Consequently, a plurality of punch holes 9*h* are formed in a plurality of locations of the sheet member 9 along the conveying direction. The procedure of the conveying direction punching process will be described later.

The sheet member 9 having the punch holes 9*h* formed therein is conveyed along the main conveyance path 500 by the following conveying roller 51*a*, and further fed out from the main conveyance path 500 to the sheet aligning device 7 by the intermediate conveying roller 51*b*.

<Step S104>

Then, the conveyance control portion 82 and the punching control portion 83 repeat the conveying direction punching process until the conveying direction punching process ends for a preset number of the sheet members 9.

<Step S105>

When the conveying direction punching process ends for the preset number of the sheet members 9, the stapling device 74 performs the stapling process on a preset position of a bundle of the sheet members 9.

<Step S106>

Then, the conveyance control portion 82 controls the solenoid 58 and the third conveying motor 57 so as to cause the discharge roller 51*c* to shift to the closed state and to rotate in the forward direction. Consequently, the bundle of the sheet members 9 is discharged onto the second discharge tray 54. Thereby, the image-forming-punching-stapling-process ends.

[Conveying Direction Punching Process]

Next, an exemplary procedure of the conveying direction punching process executed by the conveyance control portion 82 and the punching control portion 83 of the control portion 8 will be described with reference to the flowchart shown in FIG. 14.

In the following description, S201, S202, . . . denote identification characters of steps executed by the conveyance control portion 82 and the punching control portion 83. The preceding conveying roller 32*a* and the following conveying roller 51*a* are rotating at the time of start of the conveying direction punching process.

<Step S201>

In the conveying direction punching process, the conveyance control portion 82 determines, by monitoring, whether or not the leading end of the sheet member 9 has been detected by the sheet sensor 62.

<Step S202>

When the sheet sensor 62 has detected the leading end of the sheet member 9, the punching control portion 83 causes the punching unit 60 to shift to a target position in the second direction R2. The target position is a position defined in accordance with a preset condition for the punching.

<Step S203>

Furthermore, the conveyance control portion 82 causes the second conveying motor 56 to operate. Consequently, the intermediate conveying roller 51*b* and the aligning rotational member 73 rotate.

<Step S204>

When the sheet sensor 62 has detected the leading end of the sheet member 9, the conveyance control portion 82 performs control for conveying the sheet member 9 to an i-th punched position. "i" is a variable representing the number assigned to the punch hole 9*h* in the first direction R1, and has an initial value of 1. The punched position is the position of the sheet member 9 at the time when the sheet member 9 is subjected to the punching by the punching device 6.

When the sheet member 9 has been conveyed by a conveyance distance that is preset for each number (i) of the punch hole 9*h* since the leading end of the sheet member 9 has been detected by the sheet sensor 62, the conveyance control portion 82 determines that the sheet member 9 has reached the i-th punched position.

The conveyance control portion 82 can determine the conveyance distance of the sheet member 9 by counting the number of pulses of a drive signal outputted to the first conveying motor 34. The number of pulses of the drive signal represents the number of rotations of the first conveying motor 34.

That is, the conveyance control portion 82 determines that the sheet member 9 has reached the punched position, each time the first conveying motor 34 rotates a preset target number of times for each punch location of the sheet member 9 since the leading end of the sheet member 9 has been detected by the sheet sensor 62.

<Step S205>

Furthermore, the conveyance control portion 82 determines whether the sheet member 9 unreaches the takeover position when the sheet member 9 has reached the i-th punched position. As described above, the takeover position is a position at which the sheet member 9 extends over the following conveying roller 51*a* and the intermediate conveying roller 51*b*. The conveyance control portion 82 that executes the process step of step S205 is an example of the position determination portion.

In the present embodiment, the conveyance control portion 82 determines that the sheet member 9 has reached the takeover position when the sheet member 9 has been conveyed by a predetermined upper limit conveyance distance since the leading end of the sheet member 9 has been detected by the sheet sensor 62.

That is, the conveyance control portion 82 of the present embodiment determines whether or not the sheet member 9 has reached the takeover position, in accordance with whether or not the number of times of rotations of the first conveying motor 34 has reached the preset upper limit number of times of rotations since the leading end of the sheet member 9 has been detected by the sheet sensor 62 (S205).

<Step S206, S207>

Then, each time the sheet member 9 reaches the i-th punched position, the conveyance control portion 82 temporarily stops the first conveying motor 34 (S206, S207). As a result of the first conveying motor 34 being temporarily stopped, the rotation of the preceding conveying roller 32*a* and the following conveying roller 51*a* is temporarily stopped. Thus, conveying of the sheet member 9 in the introduction conveyance path 50 is temporarily stopped.

If it is determined that the sheet member 9 having reached the i-th punched position unreaches the takeover position, the conveyance control portion 82 continuously operates the second conveying motor 56 (S206). As a result of the second conveying motor 56 being continuously operated, the intermediate conveying roller 51*b* and the aligning rotational member 73 continuously rotate.

On the other hand, if it is determined that the sheet member 9 having reached the i-th punched position has reached the takeover position, the conveyance control portion 82 temporarily stops the second conveying motor 56 as well (S207). Consequently, the intermediate conveying roller 51*b* and the aligning rotational member 73 are temporarily stopped, together with the following conveying roller 51*a*.

<Step S208>

The punching control portion 83 operates the punching portion 61 each time the first conveying motor 34 is temporarily stopped. Consequently, the i-th punch hole 9*h* is formed in the sheet member 9.

<Step S209>

Next, the conveyance control portion 82 increments the number "i" of the punch hole 9*h*.

<Step S210>

Furthermore, the conveyance control portion 82 operates the first conveying motor 34 and the second conveying motor 56 again. If the sheet member 9 having reached the i-th punched position unreaches the takeover position, the operation of the second conveying motor 56 is continued.

At steps S207 and S210, the conveyance control portion 82 controls the first conveying motor 34 and the second conveying motor 56 so as to start and stop the rotation of the following conveying roller 51*a* and the intermediate conveying roller 51*b* in synchronization with each other.

The following conveying roller 51*a* functions as a so-called registration roller. Therefore, a grip force, for the sheet member 9, by the following conveying roller 51*a* is higher than that by the other conveying rollers. The rotation shaft of the following conveying roller 51*a* is connected to the first conveying motor 34 via a gear. Accordingly, when the first conveying motor 34 is stopped, the following conveying roller 51*a* may very slightly rotate in the backward direction as a result of backlash of the gear. When the following conveying roller 51*a* rotates in the backward direction, the sheet member 9 is retracted upstream in the conveying direction from the intended position at which the sheet member 9 has been temporarily stopped. When the punching is performed in a state in which the sheet member 9 is retracted from the intended position in this manner, the punch hole 9*h* may not be formed in an intended correct position. In order to address this, at step S207, the conveyance control portion 82 may stop the second conveying motor 56 with a slight delay after stopping of the first conveying motor 34. Consequently, during a period from when the first conveying motor 34 has been stopped until when the second conveying motor 56 is stopped, the intermediate conveying roller 51*b* can inhibit, via the sheet member 9, the following conveying roller 51*a* from rotating in the backward direction immediately after stopping of the following conveying roller 51*a*. As a result, the positional deviation of the sheet member 9 resulting from the rotation of the following conveying roller 51*a* in the backward direction can be prevented, so that a punch hole 9*h* is formed in a correct position.

<Step S211>

Furthermore, the conveyance control portion 82 determines whether or not a predetermined end condition is satisfied. The end condition is that the formation of all the punch holes 9*h* has ended. The end condition is satisfied if the number "i" of the punch hole 9*h* exceeds the total number of the punch holes 9*h* to be formed.

If it is determined that the end condition is not satisfied, the conveyance control portion 82 and the punching control portion 83 repeat the process steps from step S202.

<Step S212>

On the other hand, if it is determined that the end condition is satisfied, the conveyance control portion 82 executes a process for taking, in the sheet aligning device 7, the sheet member 9 that is fed out from the main conveyance path 500.

Specifically, the conveyance control portion 82 controls the solenoid 58 and the third conveying motor 57 so as to firstly cause the discharge roller 51*c* to rotate in the forward direction while maintaining the discharge roller 51*c* in the open state.

Subsequently, the conveyance control portion 82 controls the solenoid 58 and the third conveying motor 57 so as to cause the discharge roller 51*c* to shift to the closed state and to rotate in the backward direction. Consequently, the discharge roller 51*c* conveys the sheet member 9 on the inclined tray 71 obliquely downward until the lower end of the sheet member 9 reaches the aligning rotational member 73.

Furthermore, the conveyance control portion 82 controls the solenoid 58 and the third conveying motor 57 so as to cause the discharge roller 51*c* to shift to the open state and to stop rotating. Consequently, the aligning rotational member 73 conveys the sheet member 9 obliquely downward to the alignment position. After the process step of step S212, the conveying direction punching process ends.

In the present embodiment, the second conveying motor 56 is shared as the drive source of the intermediate conveying roller 51*b* and the aligning rotational member 73. In addition, the conveyance control portion 82 controls whether or not the second conveying motor 56 is to be temporarily stopped, in accordance with whether or not the sheet member 9 has reached the takeover position.

More specifically, at steps S206, S207, and S210, the conveyance control portion 82 temporarily stops the first conveying motor 34 each time the sheet member 9 reaches the position at which it is subjected to the punching. The conveyance control portion 82 that executes this process is an example of the first conveyance control portion.

In the present embodiment, at steps S206, S207, and S210, the conveyance control portion 82 temporarily stops the first conveying motor 34 each time the first conveying motor 34 rotates a preset target number of times for each punch location of the sheet member 9 since the leading end of the sheet member 9 has been detected by the sheet sensor 62.

At steps S206 and S210, the conveyance control portion 82 continuously operates the second conveying motor 56 if it is determined that the sheet member 9 unreaches the takeover position, each time the sheet member 9 has reached the position at which it is subjected to the punching. The conveyance control portion 82 that executes this process is an example of the second conveyance control portion.

Furthermore, at steps S207 and S210, the conveyance control portion 82 temporarily stops the second conveying motor 56 if it is determined that the sheet member 9 has reached the takeover position, each time the sheet member 9 has reached the position at which it is subjected to the punching. The conveyance control portion 82 that executes this process is also an example of the second conveyance control portion. Through the above-described controls, misalignment of the sheet members 9 resulting from the temporary stopping of the aligning rotational member 73 can be avoided.

Therefore, according to the present embodiment, even in the case where the second conveying motor 56 that drives the intermediate conveying roller 51*b* and the aligning rotational member 73 that are located following the punching device 6 is shared, it is not necessary to add a drive mechanism for causing a pair of rollers of the intermediate conveying roller 51*b* to be separated from each other. This contributes to compactness of the apparatus and reduction in cost and noise for the apparatus.

In the present embodiment, the sheet sensor 62 used for the positional control of the punching is also used for determining whether or not the sheet member 9 has reached the takeover position. This makes it possible to determine the position of the sheet member 9 with high precision, without adding a new sensor.

Second Embodiment

Figure 15:
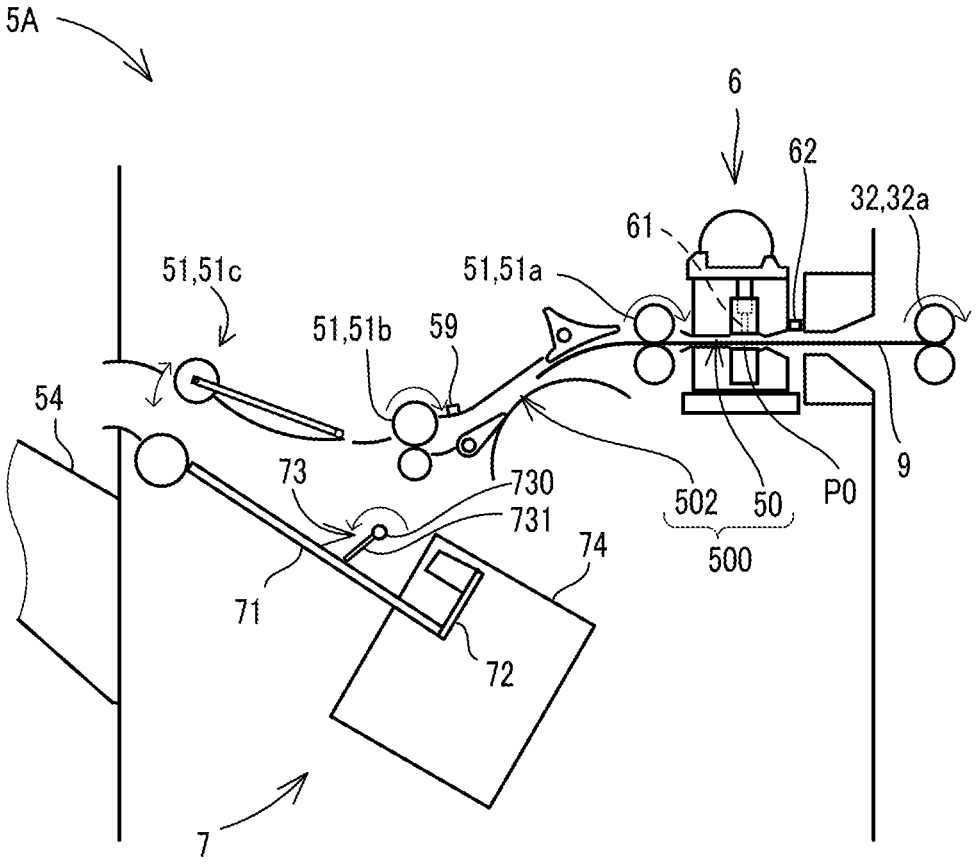
FIG. 15 is a diagram showing a configuration of a portion including a punching device and a sheet aligning device of a sheet processing apparatus according to a second embodiment.

Next, a sheet processing apparatus 5A according to a second embodiment will be described with reference to FIG. 15. FIG. 15 is a diagram showing a configuration of the portion including a punching device 6 and a sheet aligning device 7 in the sheet processing apparatus 5A.

In FIG. 15, the same components as shown in FIGS. 3, and 5 to 10 are denoted by the same reference numerals. In the following, the difference, in the sheet processing apparatus 5A, from the sheet processing apparatus 5 will be described.

The sheet processing apparatus 5A has a configuration in which a sheet sensor 59 is added to the sheet processing apparatus 5 shown in FIGS. 3, and 5 to 10.

The sheet sensor 59 is a sensor for detecting the sheet members 9 in the main conveyance path 500 between the following conveying roller 51*a* and the intermediate conveying roller 51*b* at a position closer to the intermediate conveying roller 51*b*. The sheet sensor 59 may be a reflective photosensor or a transmissive photosensor, for example.

Figure 13:
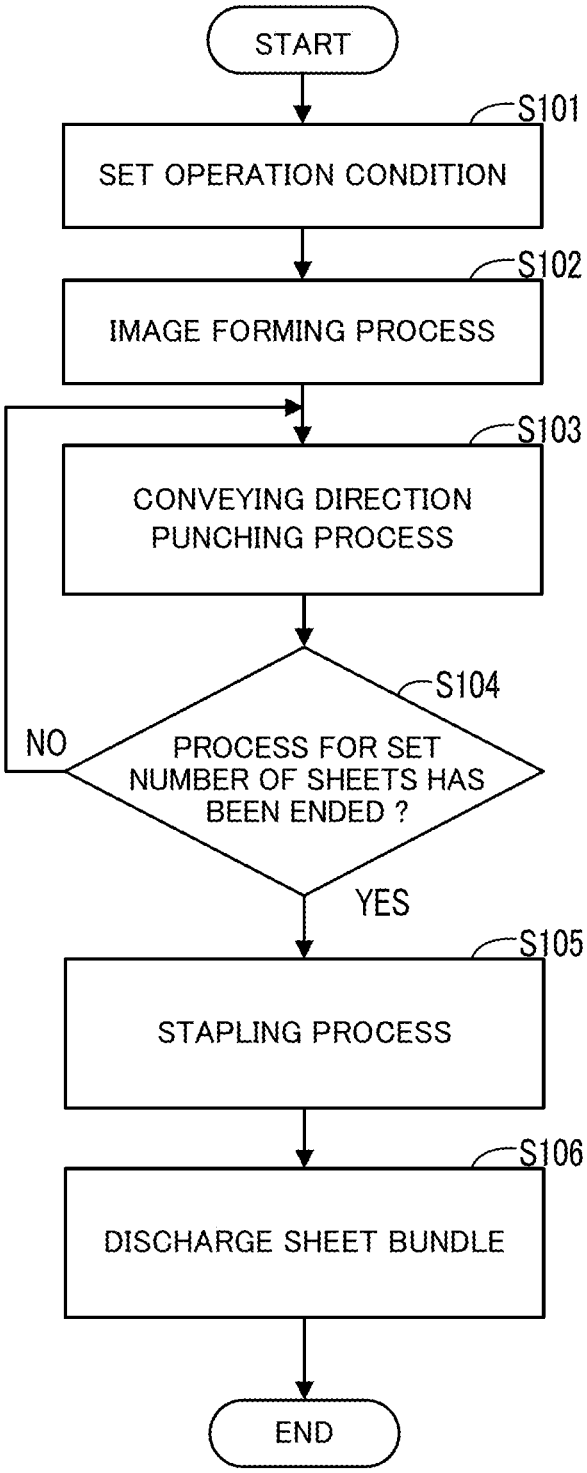
FIG. 13 is a flowchart illustrating an exemplary procedure of an image-forming-punching-stapling-process executed in the image forming system including the sheet processing apparatus according to the first embodiment.

In the case where the sheet processing apparatus 5A executes the conveying direction punching process shown in FIG. 13, the conveyance control portion 82 determines, at step S205, the position of the sheet member 9 in accordance with a detection result from the sheet sensor 59.

That is, if it is determined at step S205 that the sheet sensor 59 has not detected the sheet member 9, the conveyance control portion 82 determines that the sheet member 9 unreaches the takeover position. If it is determined that the sheet sensor 59 has detected the sheet member 9, the conveyance control portion 82 determines that the sheet member 9 has already reached the takeover position.

Also when the sheet processing apparatus 5A is adopted, the same effect as the effect achieved by using the sheet processing apparatus 5 can be achieved. The conveyance control portion 82 that executes the process of step S205 shown in FIG. 14 in the present embodiment is also an example of the position determination portion.

[Application Example]

Figure 14:
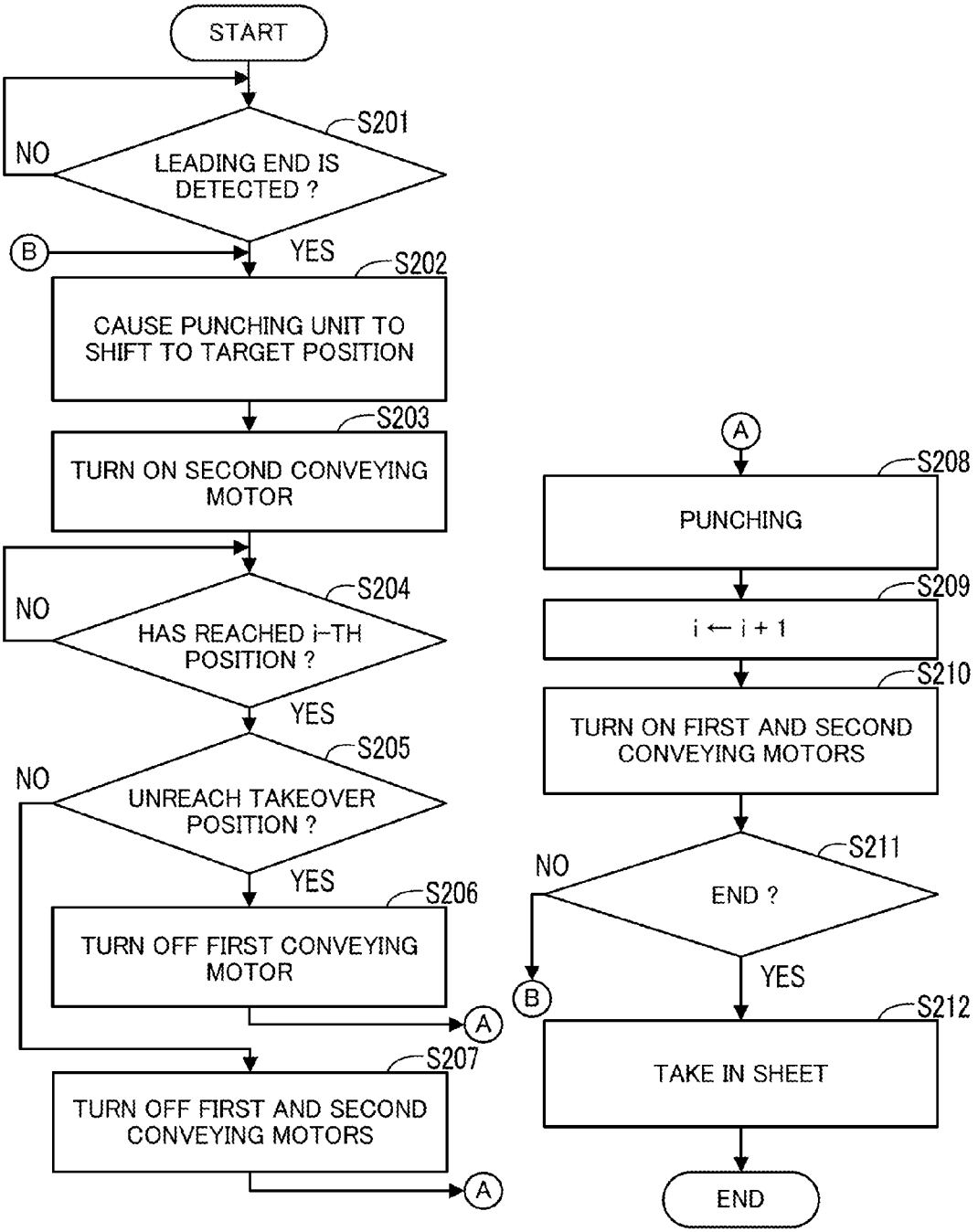
FIG. 14 is a flowchart illustrating an exemplary procedure of a conveying direction punching process executed in the punching device according to the first embodiment.

The conveyance control portion 82 of the sheet processing apparatus 5 may determine at step S205 in FIG. 14 that the sheet member 9 unreaches the takeover position when the punching is performed on a predetermined part of the sheet member 9 on the leading end side. In this case, the conveyance control portion 82 determines that the sheet member 9 has reached the takeover position when the punching is performed on the remaining part of the sheet member 9.

More specifically, the number "k" that represents a threshold value for the number of punch locations from the leading end side of the sheet member 9 is preset. The number "k" is determined in advance in accordance with the size of the sheet member 9 and the number of times the punching is performed, which are set in the operation condition setting process.

Then, if the punching is performed on locations preceding the k-th location from the leading end side of the sheet member 9, the conveyance control portion 82 determines at step S205 in FIG. 14 that the sheet member 9 unreaches the takeover position. If the punching is performed on the remaining locations on the trailing end side of the sheet member 9, the conveyance control portion 82 determines that the sheet member 9 has already reached the takeover position.

According to the above-described application example, it is possible to determine the position of the sheet member 9 in a simple manner. The conveyance control portion 82 that executes the process of step S205 in FIG. 14 in this application example is also an example of the position determination portion.

The sheet processing apparatus and the image forming system according to the present disclosure can be implemented by freely combining the embodiments and/or the application example as described above, or by modifying or partially omitting the embodiments and/or the application example as appropriate within the scope of the disclosure defined by claims.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet processing apparatus comprising:

a first conveying roller pair configured to be rotationally driven by a first motor and convey a sheet member along a conveyance path;

a punching device configured to sequentially perform punching on a plurality of locations of the sheet member along a conveying direction;

a second conveying roller pair configured to be rotationally driven by a second motor and feed out the sheet member from the conveyance path to an inclined tray located therebelow, while nipping the sheet member that is subjected to the punching and thereafter conveyed by the first conveying roller pair;

an aligning rotational member configured to be rotationally driven by the second motor, the aligning rotational member includes an elastic portion that comes into intermittent contact with an upper surface of the sheet member on the inclined tray and cause, by using the elastic portion that pivots, the sheet member that is sequentially fed out from the second conveying roller pair to shift to an alignment position at which a trailing end of the sheet member is in contact with a stopper located on a lower end side of the inclined tray;

a first conveyance control portion configured to temporarily stop the first motor each time the sheet member reaches a position at which the sheet member is subjected to the punching;

a position determination portion configured to determine whether or not the sheet member that is subjected to the punching has reached a position at which the sheet member is nipped by the second conveying roller pair; and a second conveyance control portion configured to, each time the sheet member reaches the position at which the sheet member is subjected to the punching, continuously operate the second motor if it is determined that the sheet member has not reached the position at which the sheet member is nipped by the second conveying roller pair, and temporarily stop the second motor if it is determined that the sheet member has reached the position at which the sheet member is nipped by the second conveying roller pair.

2. The sheet processing apparatus according to claim 1, wherein the position determination portion determines that the sheet member unreaches the position at which the sheet member is nipped by the second conveying roller pair when the punching is performed on a predetermined part of the sheet member on a leading end side of the sheet member, and determines that the sheet member has reached the position at which the sheet member is nipped by the second conveying roller pair when the punching is performed on the remaining part of the sheet member.

3. The sheet processing apparatus according to claim 1, further comprising a sheet sensor configured to detect the sheet member at a position, of the sheet member, upstream of a punching position of the punching device, in the conveying direction, in the conveyance path, wherein the first conveyance control portion temporarily stops the first motor each time the first motor rotates a preset target number of times for each punch location of the sheet member since the sheet member has been detected by the sheet sensor, and the position determination portion determines a position of the sheet member in accordance with whether or not a number of times of rotations of the first motor has reached a preset upper limit number of times of rotations since the sheet member has been detected by the sheet sensor.

4. The sheet processing apparatus according to claim 1, further comprising a sheet sensor configured to detect the sheet member in the conveyance path between the first conveying roller pair and the second conveying roller pair at a position closer to the second conveying roller pair, wherein the position determination portion determines a position of the sheet member in accordance with a detection result from the sheet sensor.

5. The sheet processing apparatus according to claim 1, wherein the punching device is able to be reciprocated and displaced along a direction orthogonal to the conveying direction in which the sheet member is conveyed, and is capable of performing the punching on a portion, of the sheet member, which is located on a first edge side closer to a first side end of the conveyance path and a portion, of the sheet member, which is located on a second edge side closer to a second side end of the conveyance path.

6. The sheet processing apparatus according to claim 1, wherein a grip force, for the sheet member, by the first conveying roller pair is higher than a grip force, for the sheet member, by the second conveying roller pair, and, each time the sheet member reaches the position at which the sheet member is subjected to the punching, the second conveyance control portion stops the second motor after the first motor has been stopped if it is determined that the sheet member has reached the position at which the sheet member is nipped by the second conveying roller pair.

7. The sheet processing apparatus according to claim 2, wherein a threshold value for a number of times of the punching from the leading end side of the sheet member is set in accordance with a size of the sheet member and a number of times the punching is performed on the sheet member, and the position determination portion determines whether or not the sheet member has reached the position at which the sheet member is nipped by the second conveying roller pair by using the threshold value.

8. An image forming system comprising:

an image forming apparatus configured to form an image on a sheet member; and the sheet processing apparatus according to claim 1, the sheet processing apparatus being capable of performing the punching on the sheet member that is conveyed from the image forming apparatus.

* * * * *